US011362431B1

(12) United States Patent
Yo et al.

(10) Patent No.: US 11,362,431 B1
(45) Date of Patent: Jun. 14, 2022

(54) OPTICALLY TRANSPARENT RADAR ABSORBING MATERIAL (RAM)

(71) Applicant: Oceanit Laboratories, Inc., Honolulu, HI (US)

(72) Inventors: Derek Ah Yo, Honolulu, HI (US); Ashavani Kumar, Sunnyvale, CA (US); Sumil Thapa, Honolulu, HI (US)

(73) Assignee: Oceanit Laboratories, Inc., Honolulu, HI (US)

( * ) Notice: Subject to any disclaimer, the term of this patent is extended or adjusted under 35 U.S.C. 154(b) by 616 days.

(21) Appl. No.: 15/184,988

(22) Filed: Jun. 16, 2016

Related U.S. Application Data

(60) Provisional application No. 62/180,598, filed on Jun. 16, 2015.

(51) Int. Cl.
*H01Q 17/00* (2006.01)

(52) U.S. Cl.
CPC ..... *H01Q 17/00* (2013.01)

(58) Field of Classification Search
CPC ..... H01Q 17/00
USPC ..... 342/1
See application file for complete search history.

(56) References Cited

U.S. PATENT DOCUMENTS 3,309,704 A * 3/1967 Klingler ..... H01Q 17/007 342/3
3,314,071 A * 4/1967 Lader ..... H01Q 19/022 343/912
3,325,808 A * 6/1967 Manning ..... H01Q 17/007 342/3
3,568,195 A * 3/1971 Wesch ..... H01Q 17/004 342/1
4,012,738 A * 3/1977 Wright ..... H01Q 17/004 428/116
4,651,152 A * 3/1987 Harmuth ..... G01S 13/0209 342/13
5,047,296 A * 9/1991 Miltenberger ..... H01F 10/132 428/813
5,099,242 A * 3/1992 Jaggard ..... H01Q 15/006 342/4
5,148,172 A * 9/1992 Kumurdjian ..... C09D 5/32 342/1
5,278,562 A * 1/1994 Martin ..... H01Q 17/007 343/873
5,298,903 A * 3/1994 Janos ..... H01Q 17/00 342/4
5,488,371 A * 1/1996 Targove ..... H01Q 17/00 342/1

(Continued)

FOREIGN PATENT DOCUMENTS

EP 1961077 B1 * 10/2016 ..... H01Q 15/0013
WO WO-2006039699 A2 * 4/2006 ..... H01Q 1/362

(Continued)

*Primary Examiner* — Bernarr E Gregory
*Assistant Examiner* — Nuzhat Pervin
(74) *Attorney, Agent, or Firm* — Fresh IP PLC; Clifford D. Hyra; Aubrey Y Chen

(57) ABSTRACT

An optically transparent radar absorbing material has alternating layers of optically transparent conductive material with layers of even thickness of optically transparent material having a homogenous dielectric constant. The even thickness is one quarter of the wavelength of a targeted electromagnetic energy.

8 Claims, 4 Drawing Sheets
(4 of 4 Drawing Sheet(s) Filed in Color)

(56) References Cited

U.S. PATENT DOCUMENTS 5,834,904 A * 11/1998 Waymouth ..... H05B 41/24 315/85
6,538,596 B1 * 3/2003 Gilbert ..... H01Q 15/0026 342/4
7,956,793 B2 * 6/2011 Puscasu ..... H01Q 17/00 342/4
8,836,569 B1 * 9/2014 James ..... G01S 7/38 342/6
2002/0171578 A1 * 11/2002 Strait ..... H01Q 17/00 342/13
2004/0075923 A1 * 4/2004 Knobloch ..... H01Q 15/0013 359/883
2005/0124257 A1 * 6/2005 Maeuser ..... H05B 33/26 445/24
2005/0156318 A1 * 7/2005 Douglas ..... B82Y 10/00 257/761
2005/0272856 A1 * 12/2005 Cooper ..... C22C 26/00 423/447.2
2007/0171120 A1 * 7/2007 Puscasu ..... H01Q 15/0066 342/53
2007/0222658 A1 * 9/2007 Puscasu ..... H01Q 17/00 342/3
2008/0174509 A1 * 7/2008 Williams ..... H01Q 15/0073 343/872
2009/0214852 A1 * 8/2009 Kelsey ..... B32B 27/40 156/278
2010/0090879 A1 * 4/2010 Janis ..... H01Q 17/00 342/1
2010/0323178 A1 * 12/2010 Ruoff ..... C04B 35/624 252/502
2011/0102245 A1 * 5/2011 Williams ..... H01Q 15/0086 356/138
2011/0279250 A1 * 11/2011 Ryhanen ..... G06F 3/03547 340/407.2
2012/0045865 A1 * 2/2012 Afzali-Ardakani .... B82Y 40/00 977/734
2012/0127097 A1 * 5/2012 Gaynor ..... B82Y 20/00 345/206
2012/0263940 A1 * 10/2012 Arzberger ..... H01B 1/04 977/734
2013/0092676 A1 * 4/2013 Offermann ..... H05B 3/86 219/203
2013/0256105 A1 * 10/2013 Lim ..... G06F 3/041 200/275
2013/0335254 A1 * 12/2013 Avouris ..... H01Q 17/00 342/3
2014/0111844 A1 * 4/2014 Puscasu ..... H01Q 15/0066 359/245
2014/0319385 A1 * 10/2014 Mikhailov ..... B82Y 20/00 257/29
2014/0342142 A1 * 11/2014 Wu ..... H01B 1/24 428/220
2015/0036257 A1 * 2/2015 Cheng ..... G06F 1/1652 361/220
2015/0068883 A1 * 3/2015 Chi ..... G06F 3/0446 29/622
2015/0123872 A1 * 5/2015 Fujita ..... G01S 7/03 343/872
2015/0255184 A1 * 9/2015 Li ..... H01L 21/56 427/122
2015/0343884 A1 * 12/2015 Rousselet ..... B32B 37/14 359/360
2016/0026284 A1 * 1/2016 Wang ..... G06F 3/0445 345/174
2016/0071913 A1 * 3/2016 Kim ..... H01L 51/56 438/34

FOREIGN PATENT DOCUMENTS

WO WO-2007070540 A2 * 6/2007 ..... G01J 3/108
WO WO-2007149121 A2 * 12/2007 ..... H01Q 15/0013
WO WO-2016055046 A1 * 4/2016 ..... G01J 3/0278

* cited by examiner

510

520

OPTICALLY TRANSPARENT RADAR ABSORBING MATERIAL (RAM)

This application claims the benefit of U.S. Provisional Application No. 62/180,598, filed Jun. 16, 2016, which is hereby incorporated by reference in its entirety.

This Invention was made with Government support under Contract N00024-13-P-4573 awarded by NAVSEA. The Government has certain rights in this invention.

FIELD OF THE INVENTION

The application relates generally to materials for absorbing electromagnetic radar energy.

BACKGROUND

Single-layer Salisbury screens utilize an opaque conductive mesh of a specific aperture size and periodicity to filter out unwanted electromagnetic energy, but result in a reduction in optical transmission that cannot be avoided. Salisbury screens consist of three layers, a ground plane which is the underlying metallic surface to be concealed from radar, a lossless dielectric of a thickness equal to a quarter of the wavelength of the radar wave to be absorbed, and a thin glossy screen. When the radar wave strikes the front surface of the dielectric, it splits into two waves. One wave is reflected from the glossy screen, while the second wave passes into the dielectric layer, is reflected from the metal surface, and passes back out of the dielectric into the surrounding medium. The extra distance the second wave travels causes it to be 180° out of phase with the first wave by the time it emerges from the dielectric surface. When the second wave reaches the surface, the two waves combine and cancel each other out due to interference. Therefore, there is no wave energy reflected back to the radar receiver.

A Jaumann absorber may have two equally spaced reflective surfaces and a conductive ground plane. Being a resonant absorber (i.e. it uses wave interfering to cancel the reflected wave), the Jaumann layer is dependent upon $\lambda/4$ spacing between the first reflective surface and the ground plane and between the two reflective surfaces (a total of $\lambda/4+\lambda/4$). Because the wave can resonate at two frequencies, the Jaumann layer produces two absorption maxima across a band of wavelengths. These absorbers must have all of the layers parallel to each other and the ground plane that they conceal. More elaborate Jaumann absorbers use series of dielectric surfaces that separate conductive sheets. The conductivity of those sheets increases with proximity to the ground plane. Jaumann absorbers are opaque and cannot be used to cover optically transparent surfaces, for the purpose of radar-avoidance technology.

Needs exist for improved materials for radar absorption.

SUMMARY

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the disclosed embodiments may include one or more of the features described herein.

This invention provides a system that absorbs electromagnetic radar energy incident on optically transparent surfaces, i.e. surfaces that allow light to pass through the material without being scattered, reducing the likelihood of detection, without compromising the optical transmission through the base transparent surface.

The transparent multi-layered RAM system absorbs electromagnetic radar energy incident on optically transparent substrates and materials without impeding the optical transmission capability of the base/target substrate.

These and further and other objects and features of the invention are apparent in the disclosure, which includes the above and ongoing written specification, with the drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. The invention will be more particularly described in conjunction with the following drawings wherein.

DETAILED DESCRIPTION

Figure 1:
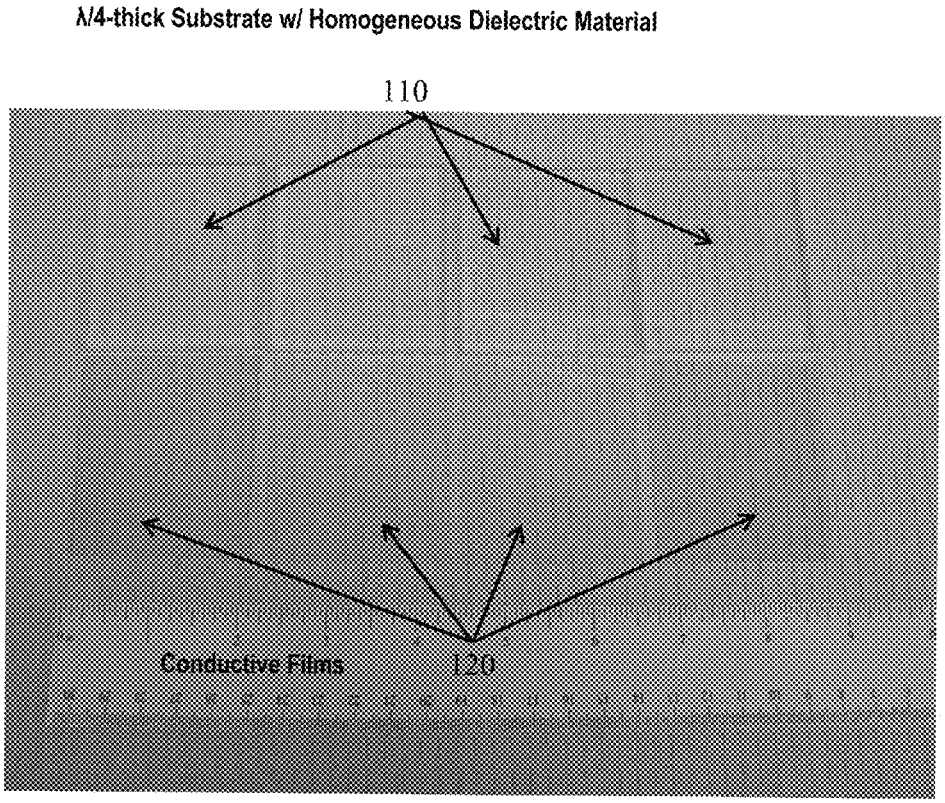
FIG. 1 shows layers of quarter-wavelength transparent material and conductive films prior to assembly, in an embodiment.
Figures 2A, 2B, 2C:
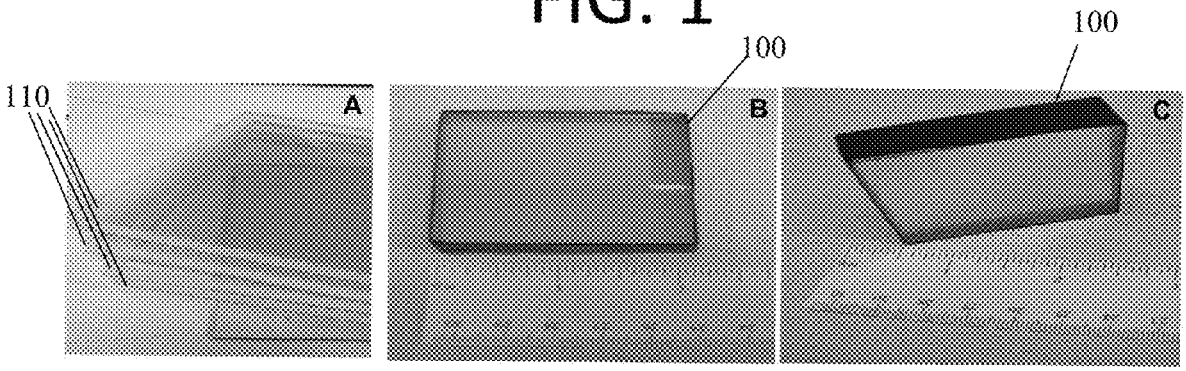
FIGS. 2A-2C show the layers of FIG. 1 stacked but unassembled (FIG. 2A), and assembled into a layered radar-absorbing material from top (FIG. 2B) and perspective (FIG. 2C) views, in an embodiment.

An optically transparent radar-absorbing material will now be disclosed in terms of various exemplary embodiments. This specification discloses one or more embodiments that incorporate features of the invention. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. When a particular feature, structure, or characteristic is described in connection with an embodiment, persons skilled in the art may effect such feature, structure, or characteristic in connection with other embodiments whether or not explicitly described.

In the several figures, like reference numerals may be used for like elements having like functions even in different drawings. The figures are not to scale. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail. Any signal arrows in the drawings/figures should be considered only as exemplary, and not limiting, unless otherwise specifically noted.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an" and "the" are intended to include the plural forms as well, unless the context clearly indicates otherwise.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

A multi-layered resonant structure composed of thin, optically transparent (visible and infrared), conductive films sandwiched between quarter-wavelength thick optically transparent (visible and infrared) lossy material serves as an optically transparent radar absorbing material (RAM). The quarter-wavelength thickness of the optically transparent material layers matches the center frequency of the electromagnetic radar energy to be absorbed. The transparent conductive films in between the quarter-wavelength thick material have specific sheet resistances that progressively increase from layer to layer as the conductive layers of the system are positioned closer to the base/target material substrate. These transparent conductive films provide the necessary energy dissipations at the specified frequencies to be absorbed while the quarter-wavelength thick layers provide the resonant structure to cause gradual destructive interference of the electromagnetic energy. A portion of incoming radar energy is reflected off each layer of material, bouncing back and forth within the resonant structure and being dissipated into heat. The combined multi-layered resonant structure provides energy absorption of over 15 dB (i.e. ~32 times less reflected energy) over a wide range of frequencies.

The frequency bandwidth over which the energy is absorbed may be controlled by increasing or decreasing the number of layers of alternating conductive film and quarter-wavelength thick material used in the multi-layered system. The multi-layered resonant structure may use any type of transparent material for the quarter-wavelength thick layers, as long as the dielectric constant of the material can be determined and is fairly homogeneous such that the quarter-wavelength thickness can be determined. In most applications it is desirable to minimize total material thickness, so the transparent material may be selected such that the quarter-wavelength thickness is as small as possible, although cost, availability, ease of manufacture, etc. may also be considerations. In some applications, a thickness of ¾" or less may be desirable for practicality of manufacturing and application. Generally, there is a tradeoff between the range of wavelengths the material effectively absorbs and the material thickness.

Figure 3:
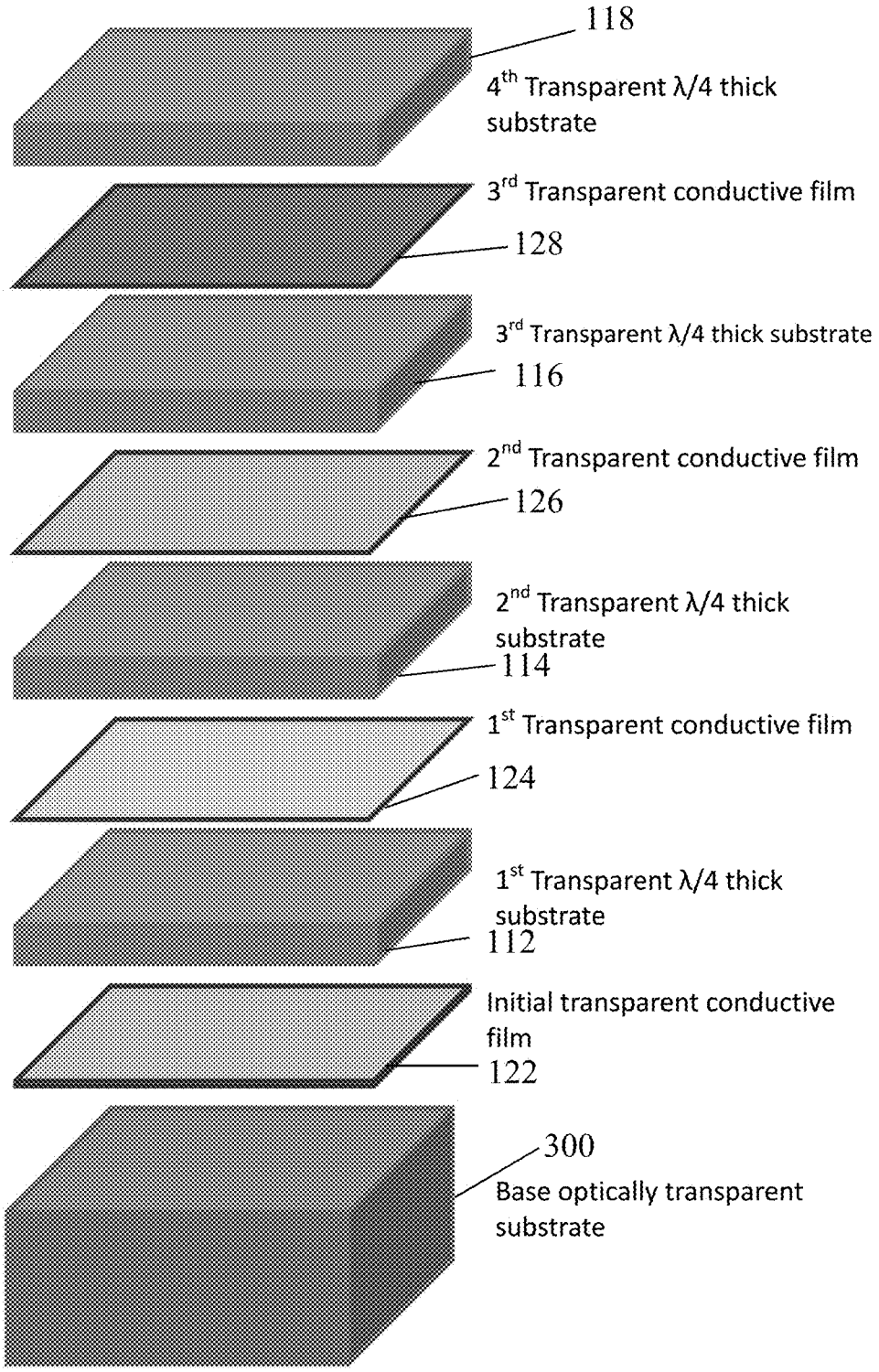
FIG. 3 is a diagram showing how each layer fits into the final multi-layered assembly, in an embodiment.

In FIGS. 1 and 2A-2C there are pictures of a transparent RAM multi-layered resonant structure 100 composed of quarter-wavelength thick transparent material 110 and various conductive films 120, both unassembled and assembled. A graphic of the various layers in the multi-layered resonant structure is shown in FIG. 3. The material shown is made up of four λ/4 thick layers 112, 114, 116, 118 with a transparent graphene conductive sheet on 0.127 mm thick PET (polyethylene terephthalate or Dacron) 124, 126, 128 at each of the λ/4 thick quartz interfaces and an initial transparent conductive Indium Tin Oxide (ITO) layer with a low sheet resistance 122 at the bottom of the stack. There are three transparent conductive graphene layers, each with a different sheet resistance. The PET is used only for convenience of manufacturing, and is the main source of loss of optical transparency in this embodiment. Quartz is nearly 100% optically transparent (in this embodiment 97-98%), however use of the PET results in an overall optical transparency of only about 50% for this embodiment, visible in FIGS. 1 and 2A-2C as a tint.

The embodiment shown in FIGS. 1 and 2A-2C is only one example of many. The selected materials and number of layers, for example, may be varied depending on the application and desired characteristics. In other embodiments, the transparent conductive layers (e.g. graphene and/or ITO) may be deposited directly on the λ/4 thick substrate layers and on the underlying optically transparent (e.g. sapphire) base substrate surface. The optically transparent base substrate surface is the existing surface that is to be protected from radar detection by application of the transparent RAM multi-layered resonant structure. Graphene has been discovered to be an excellent material for use in the conductive layers. Graphene is only angstroms thick, highly optically transparent (transmitting ~97.7% of light) and conductive. Embodiments similar to the one described with reference to FIGS. 1-3 but utilizing graphene layers deposited directly on λ/4 thick quartz substrate have been discovered to exhibit an optical transparency of about 84% with a thickness of less than 0.6 inches and a 20 dB energy reduction at a target radar center wavelength and broad bandwidth. Anti-reflective coatings may further increase that transparency. ITO and silver nanotubes are exemplary alternatives to graphene for the transparent conductive layers. Any suitable transparent conductive material may be used. Any optically transparent material with homogenous dielectric constant may be used as the λ/4 thick resonant substrate layer, such as germanium, sapphire, or any other glass.

Using the dielectric constant of the transparent lossy (resonant substrate) material (e.g. quartz) and radar wavelength targeted for absorption/dissipation, λ/4 thickness may be calculated for the resonant substrate layers using the equation $$\lambda = \frac{c_0}{f\sqrt{\varepsilon_r}},$$

where $c_0$ is the speed of light in free space, f is the frequency of interest and $\varepsilon_r$ is the relative permittivity or dielectric constant of the material. Conductivity of the conductive layers may then be determined by simulating an electromagnetic signal propagating through the layers according to known methods (as in a transmission line) and selecting resistances that result in the best signal absorption properties, for example the widest range of wavelengths reduced by a certain level (e.g. 15 dB or 20 dB). The dielectric constant is accounted for to find the λ/4 thickness of the substrate pieces (single layer) and to find correct conductivity for other layers. Higher resistances dissipate more energy, but have a high reflectivity. Therefore, performance generally improves with higher resistances in conductive sheet layers closer to the surface to be protected. A high resistance at a top surface would reflect too much radar energy, preventing the radar signal from passing into the resonant structure for dissipation. The bottom-most layer, directly above the protected surface, has a lower resistance to approach a shorted-out condition. In some embodiments, a bottom transparent sheet resistance of as little as 4 ohms/sq may be achieved, with an optical average transmission of 99.7% and above.

Figure 4:
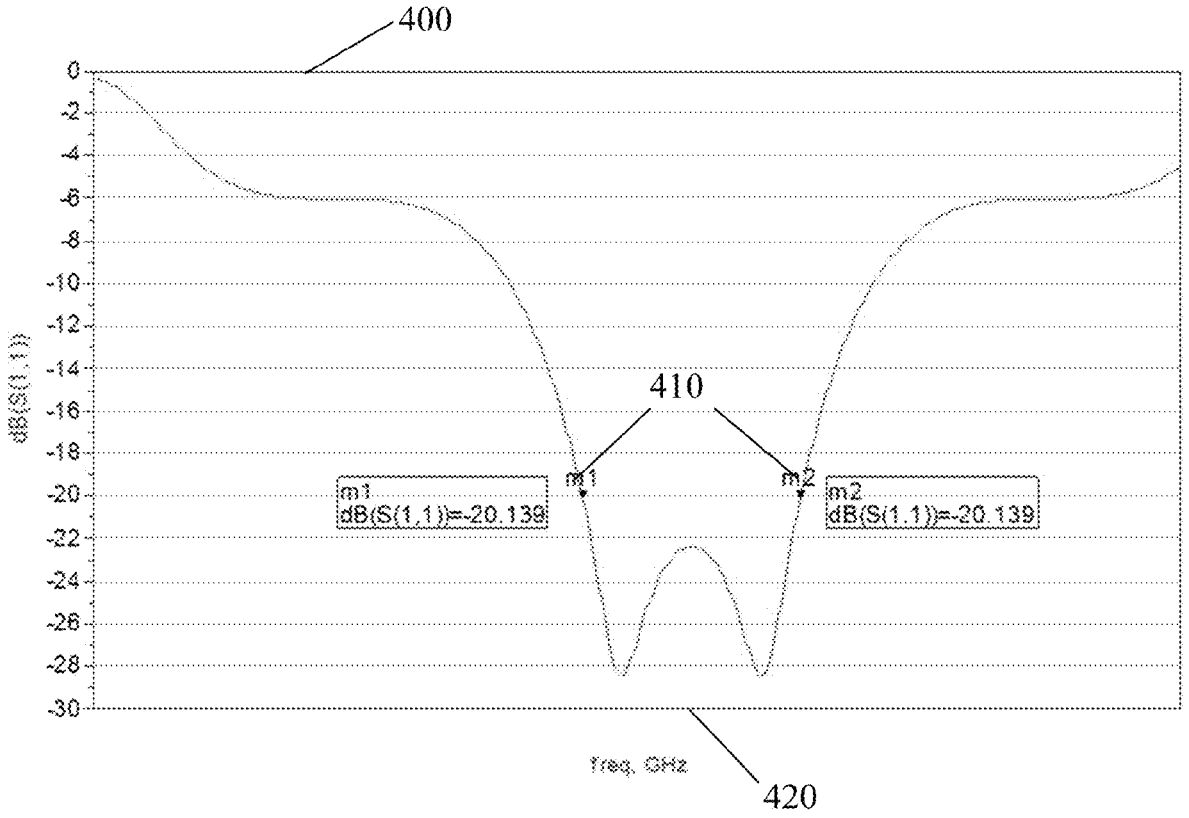
FIG. 4 is a plot showing reduction in reflected radar energy versus frequency for the layered material shown in FIGS. 2A-2C.
Figure 5A:
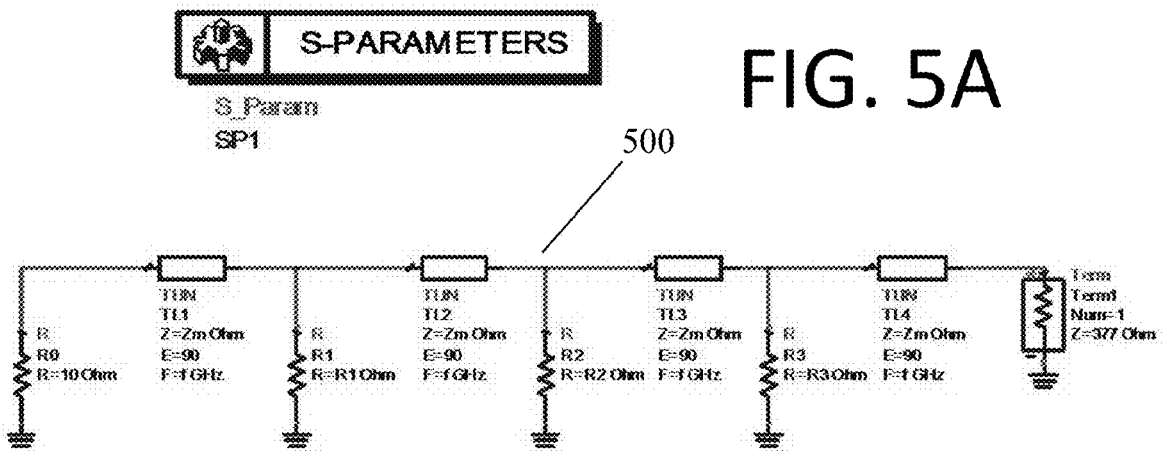
FIGS. 5A-C are diagrams showing a closed-form solution electromagnetic simulation of the assembled layered material of FIG. 2 (FIG. 5A), graphic model of the material (FIG. 5B) and overhead view of the material structure (FIG. 5C).
Figure 5B:
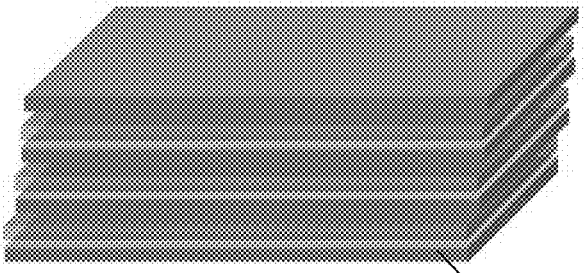
Figure 5C:
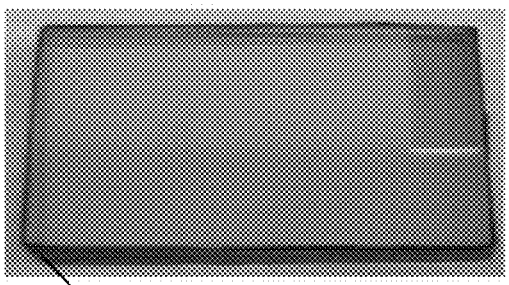

FIG. 4 shows a simulated return loss 400 for the transparent multi-layered RAM system of FIGS. 1-3, showing that it has a broad 20 dB reduction bandwidth 410 (between m1 and m2) around the center frequency 420. FIGS. 5A-5C show a closed-form solution electromagnetic simulation software model 500 (FIG. 5A), graphical model 510 (FIG. 5B) and actual structure 520 (FIG. 5C). The electromagnetic simulation 500 was found to match a finite element simulation and also measured real-life experimental data. The resistances of the conductive layers in the simulation of FIG. 5 are optimized to achieve the widest band of wavelengths having a 20 dB reduction as shown in FIG. 4.

A transparent RAM system may be implemented in the optical structures and optical sensors used by military surface ships, land vehicle windshields, aircraft canopies and any other platform that requires optical surfaces for sensor or visual observations and wants to reduce the reflected radar energy from the optical surface. It may be used in stealth platforms and in test and measurement facilities, e.g. anechoic chambers, which require visual observation of tests being performed. Primary applications include radar vulnerability reduction and electromagnetic test and measurement. For example in an anechoic chamber, the chamber is designed to avoid signal reflection from chamber walls, simulating a quiet open space of infinite dimensions. Such chambers are useful for testing where electromagnetic signals are coming from a test object and the tester wants to measure those electromagnetic signals without interference from reflections from chamber walls. However, the tester may desire a window or optical lens for viewing the testing conditions, necessitating a transparent RAM to cover the window/lens to avoid reflections.

These and other objectives and features of the invention are apparent in the disclosure, which includes the above and ongoing written specification.

The invention is not limited to the particular embodiments described above in detail. Those skilled in the art will recognize that other arrangements could be devised. The invention encompasses every possible combination of the various features of each embodiment disclosed. One or more of the elements described herein with respect to various embodiments can be implemented in a more separated or integrated manner than explicitly described, or even removed or rendered as inoperable in certain cases, as is useful in accordance with a particular application While the invention has been described with reference to specific illustrative embodiments, modifications and variations of the invention may be constructed without departing from the spirit and scope of the invention as set forth in the following claims.

We claim:

1. A method of manufacturing an optically transparent radar absorbing material comprising alternating layers of even thickness of optically transparent conductive material with layers of even thickness of optically transparent material having a homogenous dielectric constant, wherein the even thickness of the optically transparent material having a homogenous dielectric constant is one quarter of the wavelength of a targeted electromagnetic energy, the method comprising:

adhering an initial transparent conductive film to a base optically transparent substrate;

adhering a first layer of optically transparent material having a homogenous dielectric constant to the initial transparent conductive film;

depositing a first transparent conductive film directly on the first layer of optically transparent material;

adhering a second layer of optically transparent material having a homogenous dielectric constant to the first transparent conductive film;

depositing a second transparent conductive film directly on the second layer of optically transparent material;

adhering a third layer of optically transparent material having a homogenous dielectric constant to the second transparent conductive film;

depositing a third transparent conductive film directly on the third layer of optically transparent material; and adhering a fourth layer of optically transparent material having a homogenous dielectric constant to the third transparent conductive film.

2. The method of claim 1, further comprising selecting resistances of the layers of optically transparent conductive material to achieve a reduction of energy of at least 20 dB over a bandwidth greater than 30% of the wavelength of the target electromagnetic energy.

3. An optically transparent radar absorbing material, comprising:

a plurality of strata, each stratum in the plurality of strata contacting at least one other stratum and each stratum comprising a layer of optically transparent conductive material and a layer of optically transparent material having a homogenous dielectric constant, thereby generating alternating layers of the optically transparent conductive material with layers of the optically transparent material;

wherein each layer in the layers of optically transparent conductive material comprises graphene deposited directly on a substrate, wherein each layer in the layers of the optically transparent material is of even thickness, and wherein the even thickness is one quarter of the wavelength of a targeted electromagnetic energy.

4. The optically transparent radar absorbing material of claim 3, wherein the substrate is the optically transparent material having a homogenous dielectric constant.

5. The optically transparent radar absorbing material of claim 3, wherein total thickness of the layers and the type of optically transparent conductive material and optically transparent material having a homogenous dielectric constant are set to achieve an optical transparency of 84% and a 20 dB energy reduction bandwidth around a target radar center wavelength, and wherein the total thickness is less than 0.6 inches.

6. The optically transparent radar absorbing material of claim 3, wherein a bottom-most layer in the layers of optically transparent material has a resistance of as little as 4 ohms/sq.

7. An optically transparent radar absorbing material, comprising:

four layers of an even thickness of optically transparent conductive material alternating with four layers of an even thickness of optically transparent material having a homogenous dielectric constant, thereby generating an optically transparent radar absorbing material having eight layers, wherein the even thickness of the optically transparent material having a homogenous dielectric constant is one quarter of the wavelength of a targeted electromagnetic energy, wherein a first, bottom-most layer in the four layers of the optically transparent conductive material is made from Indium Tin Oxide (ITO), wherein a second layer through a fourth layer in the four layers of the optically transparent conductive material is a graphene sheet on polyethylene terephthalate (PET), and wherein the second layer through the fourth layer in the four layers of the optically transparent conductive material each has a different sheet resistance.

8. The optically transparent radar absorbing material of claim 7, wherein the sheet resistances of the second layer through the fourth layer in the four layers of the optically transparent conductive material progressively increase.

* * * * *